US006684610B2

(12) United States Patent
Gorrieri et al.

(10) Patent No.: US 6,684,610 B2
(45) Date of Patent: Feb. 3, 2004

(54) MACHINE FOR PACKAGING A PILE OF PAPER PRODUCTS, SUCH AS SERVIETTES AND THE LIKE

(75) Inventors: Giordano Gorrieri, Pianoro (IT); Gabriele Montanari, Bologna (IT)

(73) Assignee: Casmatic SpA, Casalecchio de Reno (IT)

( * ) Notice: Subject to any disclaimer, the term of this patent is extended or adjusted under 35 U.S.C. 154(b) by 0 days.

(21) Appl. No.: 10/151,817

(22) Filed: May 22, 2002

(65) Prior Publication Data

US 2002/0174624 A1 Nov. 28, 2002

(30) Foreign Application Priority Data

May 22, 2001 (IT) ..... TO2001A0489

(51) Int. Cl.[7] ..... B65B 11/12; B65B 63/02
(52) U.S. Cl. ..... 53/528; 53/528; 53/230
(58) Field of Search ..... 53/228, 230, 528, 53/529, 540; 493/478

(56) References Cited

U.S. PATENT DOCUMENTS 3,766,708 A * 10/1973 Kubo et al. ..... 53/530
4,024,692 A * 5/1977 Young et al. ..... 53/228
4,738,078 A * 4/1988 Benz et al. ..... 53/228
5,046,297 A 9/1991 Lippert et al.

OTHER PUBLICATIONS

European Search Report No. EP 02 00 6859, dated Aug. 16, 2002.

* cited by examiner

*Primary Examiner*—John Sipos
(74) *Attorney, Agent, or Firm*—Sughrue Mion, PLLC

(57) ABSTRACT

A machine for packaging piles (P) of paper products, such as serviettes, handkerchiefs and the like, comprising: a feed assembly (14) for feeding a sheet of packaging material (F), comprising means (26) designed for withholding a sheet of packaging material (F) in a substantially vertical plane; a station (12) for feeding products (P) to be packaged, comprising a pusher (22) to push the products (P) to be packaged in a direction orthogonal to the aforesaid sheet of packaging material (F); a drawer device (16) comprising a bottom plate (26) and a top plate (38), in which the bottom plate (38) is mobile with respect to the bottom plate (36) between a raised position and a lowered position; a control device (58, 60, 62, 64) designed to control displacement of the drawer device (16) in a longitudinal direction (18) between a receiving position and a position of release of the products; and a second control device (52, 54, 56) independent of the aforesaid first control device for controlling displacement of the top plate (38) in a vertical direction with respect to the bottom plate (36) by a given dimension (ΔX) also with the machine moving.

7 Claims, 4 Drawing Sheets

MACHINE FOR PACKAGING A PILE OF PAPER PRODUCTS, SUCH AS SERVIETTES AND THE LIKE

BACKGROUND OF THE INVENTION

The present invention relates to a machine for packaging a pile of paper products, such as serviettes, towelettes, handkerchiefs and the like. More precisely, the present invention regards a machine according to the preamble of claim 1, which is known from the Italian patent No. 1240548. The above document describes a packaging machine for paper serviettes or the like comprising a mobile-drawer device, which moves with reciprocating motion in a longitudinal direction between a position of reception of a pile of products and a position of release. The drawer device comprises a bottom plate and a top plate, which are mobile with respect to one another between a position of insertion of a pile of products and a position of closing.

In the known machine described in the aforesaid Italian patent No. 1240548, during operation, the top plate moves cyclically with respect to the bottom plate with a travel having a constant extent, and adjustment means are provided for varying the distance between the top plate and the bottom plate in the closing position, i.e., the minimum distance between the top plate and the bottom plate. The purpose of this adjustment is to compensate for the variations in thickness of the pack which are due to a variation in the thickness of the products to be packaged. The mechanism described in the Italian patent No. 1240548 enables adjustment of the minimum distance between the top plate and the bottom plate, whilst the machine is running. The way in which the mechanism that controls movement of the top plate with respect to the bottom plate maintains, instead, always constant the extent of the travel of the top plate with respect to the bottom plate between the insertion position and the closing position of the drawer device.

The major drawback of the solution according to the prior art lies in the fact that, when the distance between the top plate and the bottom plate of the drawer device is varied, the height of the packs that are packaged inevitably varies also. Consequently, even though the number of products contained in each pack remains unvaried, if the thickness of the individual products varies, the aforesaid known packaging machine produces packs of different heights.

SUMMARY OF THE INVENTION

The purpose of the present invention is to provide a packaging machine of the mobile-drawer type that is not affected by the aforesaid drawback.

According to the present invention, this purpose is achieved by a machine having the characteristics that form the subject of the main claim.

According to the present invention, the above purpose is achieved by a machine having the characteristics that form the subject of the main claim.

BRIEF DESCRIPTION OF THE DRAWINGS

The characteristics and advantages of the present invention will emerge clearly from the ensuing detailed description, provided purely by way of non-limiting example with reference to the attached drawings, in which.

DETAILED DESCRIPTION OF THE INVENTION

Figure 1:
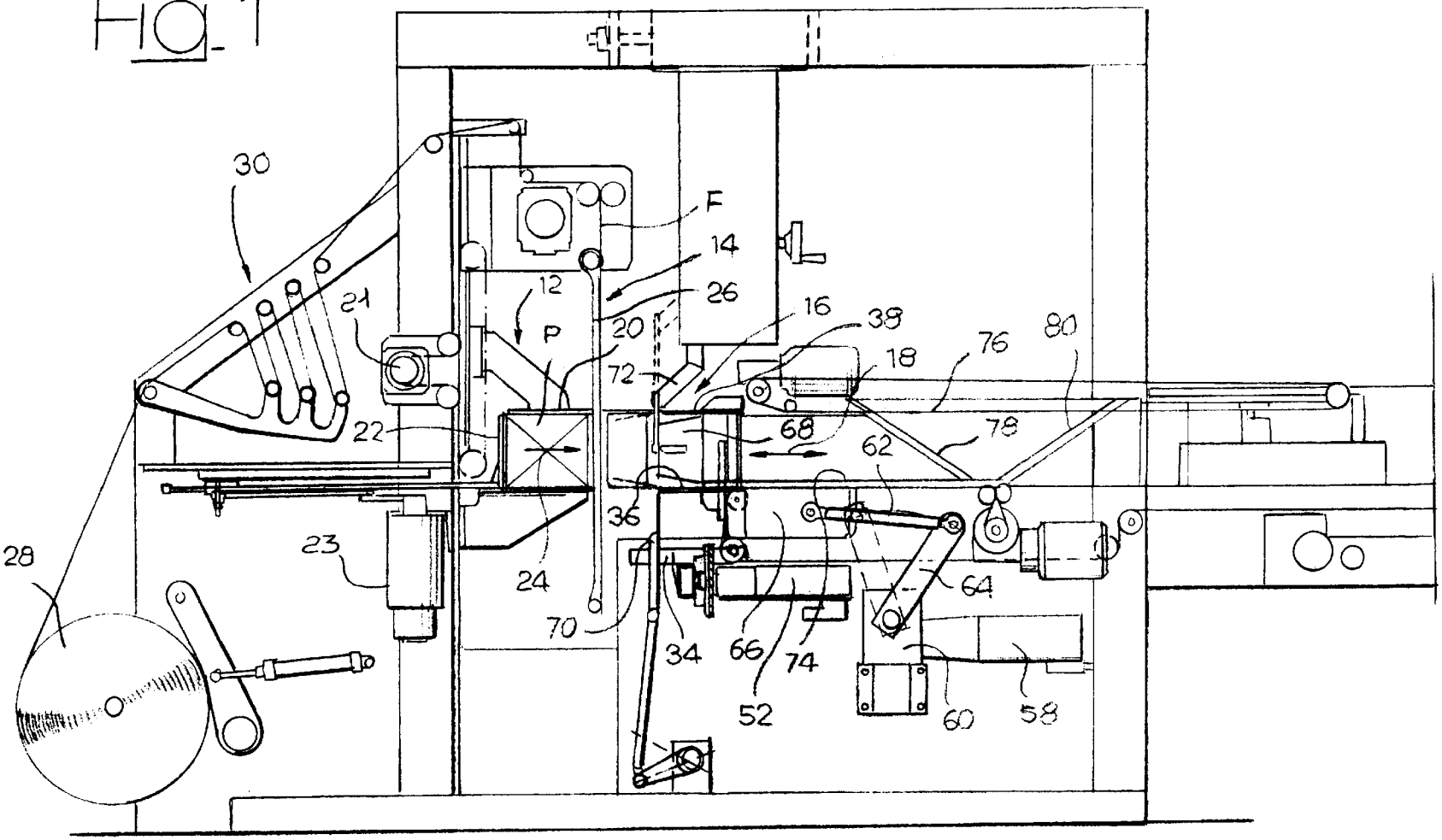
FIG. 1 is a schematic side view of a packaging machine according to the present invention.
Figure 2:
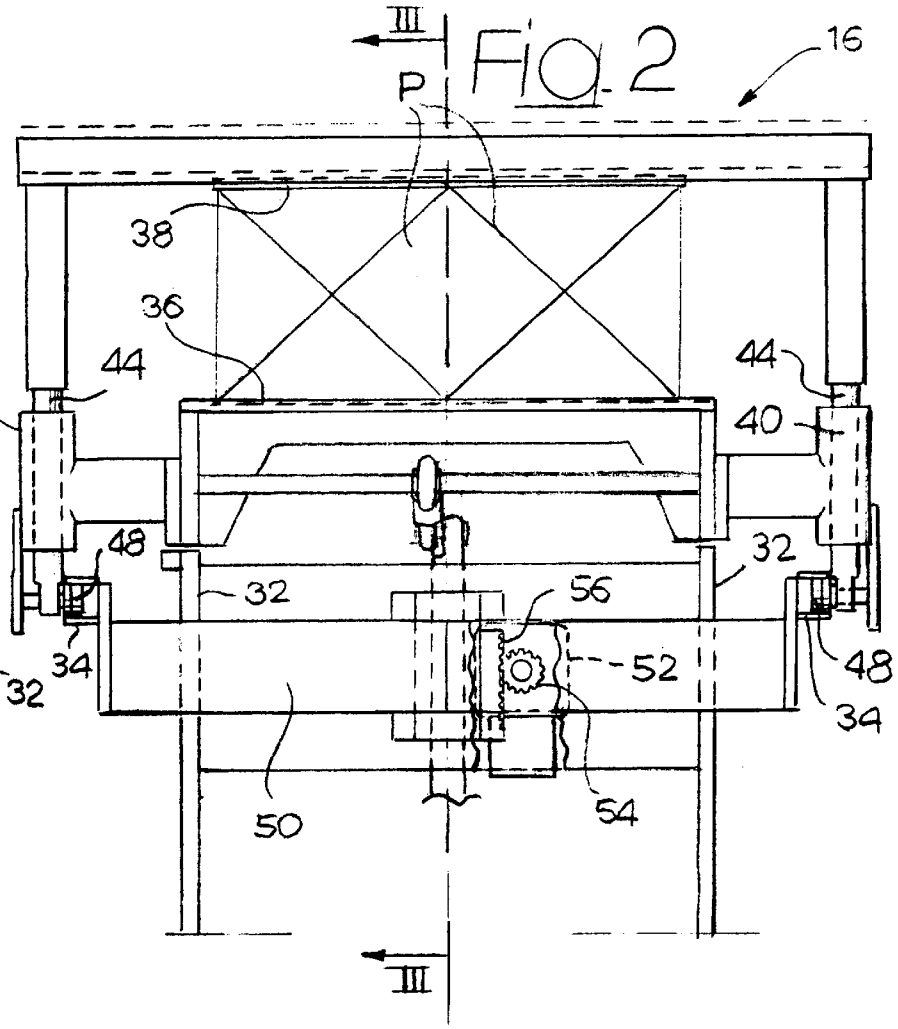
FIG. 2 is a schematic cross-sectional view according to the line II—II of FIG. 1.

With reference to FIG. 1, number 10 designates a machine for packaging piles of paper products, such as serviettes, handkerchiefs and the like, just one of which is shown in FIG. 1 and is designated by P. The machine 10 comprises a station 12 for feeding the products to be packaged, a feed assembly 14 for feeding a film of packaging material F, and a drawer device 16 which can move with reciprocating motion in the longitudinal direction indicated by the double-headed arrow 18.

The piles of products P to be packaged arrive at the feed station 12 in a direction orthogonal to the plane of representation of FIG. 1. In the feed station 12 a presser device is provided having a plate 20 which is mobile in a vertical direction for compressing the pile P of products to be packaged, which, as the machine operates, is positioned in the feed station 12. The plate 20 of the presser device is controlled by a motor 21.

A pusher device 22, controlled by a motor 23, is provided for pushing the pile P of products located in the feed station 12 towards the drawer device 16 in the direction indicated by the arrow 24.

The feed assembly 14 for feeding the film F comprises a pair of belts 26, which are associated to a suction system and are designed to withhold a portion of the film F in a vertical plane between the feed station 12 and the drawer device 16. The packaging film F comes from a reel 28 and reaches the feed assembly 14 passing through an unreeler assembly 30. Upstream of the feed assembly 14 there is also provided a cutting assembly (not shown) which is designed to make a transverse cut of a portion of film F so as to obtain sheets of packaging material having the length necessary for forming a wrapper around the pile of products P.

Figure 3:
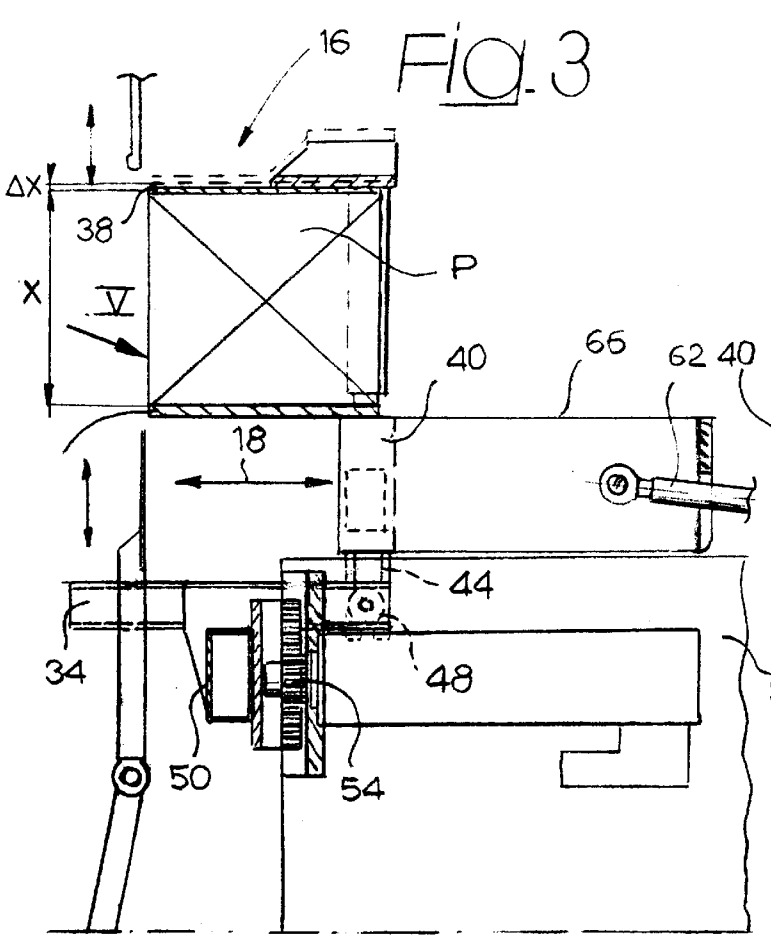
FIGS. 3 and 4 are schematic cross-sectional views according to the line III—III of FIG. 2.
Figure 4:
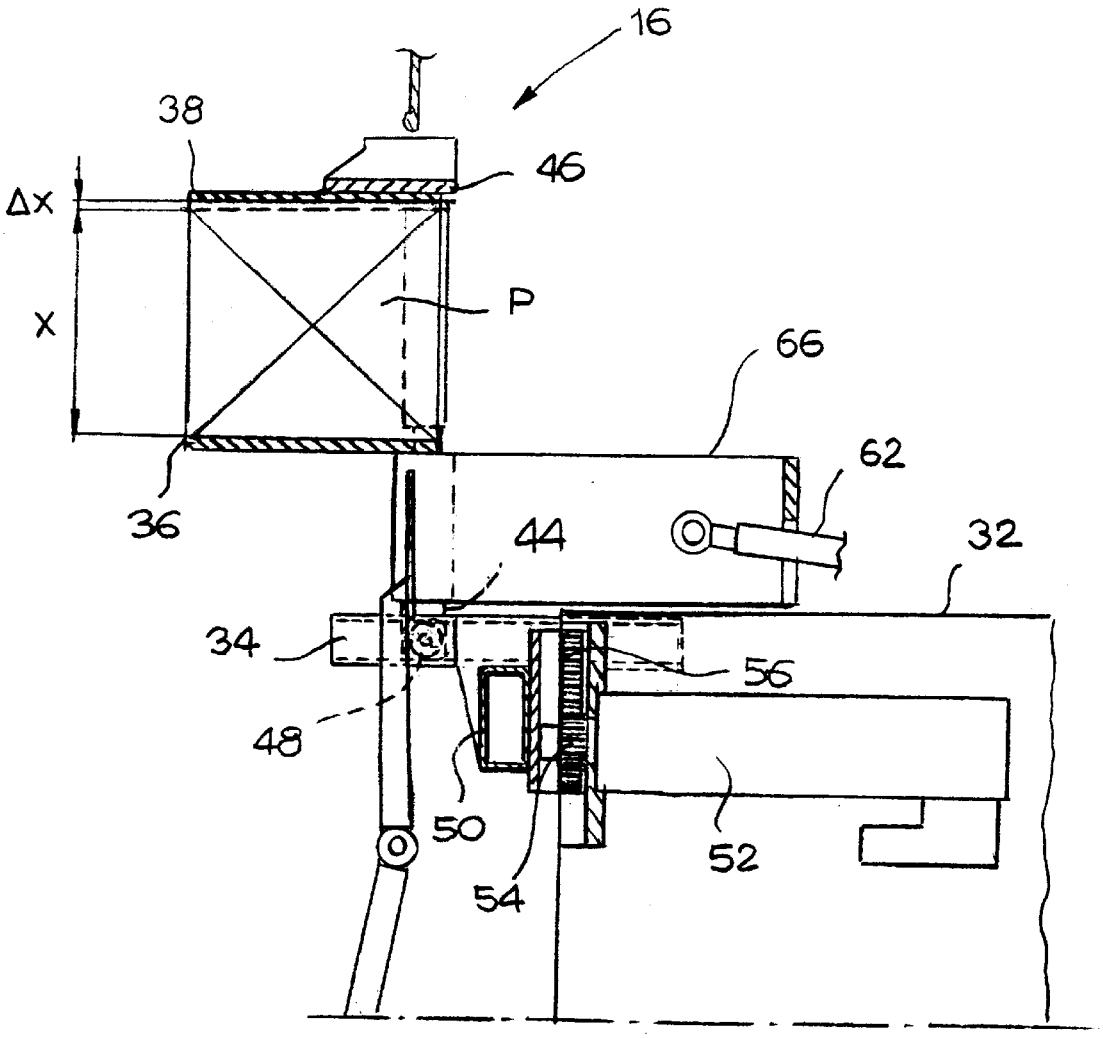
Figure 5:
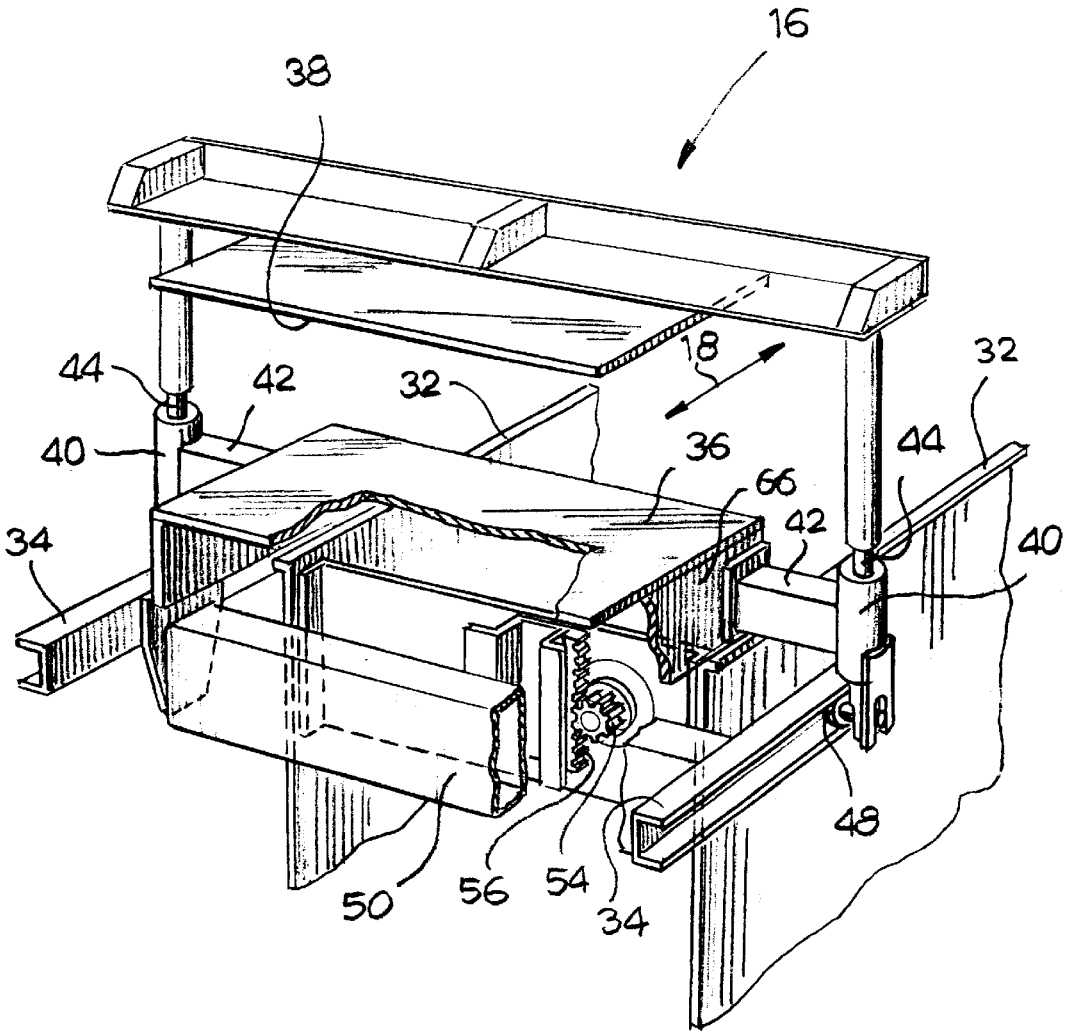
FIG. 5 is a perspective view of the drawer device in the direction indicated by the arrow V of FIG. 3.

With reference to FIGS. 2 to 5 and, in particular, to the perspective view of FIG. 5, the machine 10 comprises a pair of stationary sides that carry, in the way described in what follows, a pair of guides 34, along which the drawer device 16 moves. The drawer device 16 comprises a bottom plate 36 and a top plate 38. A pair of vertical slide guides 40 are fixed to the bottom plate 36 by means of a pair of lateral appendages 42. A pair of uprights 44 are mounted so that they can slide in a vertical direction within the respective slide guides 40. At their top ends the uprights 44 are fixed to a cross member 46 that carries the top plate 38. At their bottom ends the uprights 44 slidably engage the guides 34, for example by means of wheels 48. The guides 34 are fixed to a cross member 50 that is mobile in a vertical direction. An electric motor 52, which is controlled numerically by means of an electronic control unit (not shown), controls displacement in a vertical direction of the cross member 50 and of the guides 34, for instance by means of a pinion-and-rack mechanism 54, 56. During operation, the motor 52 is actuated in a reciprocating way, so as to control a cyclic travel in the vertical direction of the top plate 38 with respect to the bottom plate 36. By means of the program that controls the motor 52 numerically, it is possible to vary the extent of the vertical travel of the top plate 38 in a precise way.

With reference to FIG. 1, the machine 10 comprises a device that controls reciprocating movement of the drawer device 16 in the longitudinal direction 18. This device comprises an electric motor 58, a reducer 60 and a connecting-rod-and-crank mechanism 62, 64, which connects the bottom plate 36 of the drawer device 16 to the reducer 60. The connecting rod 62 is articulated to a wall 66 fixed to the bottom plate 36 of the drawer device 16 (see FIGS. 3 and 4).

During operation, the motor 58 drives the drawer device 16 in a reciprocating way between a position of receiving the products (see FIG. 4) and a position of release of the products (see FIG. 3). At the same time, the numerically controlled motor 52 controls the movement of the top plate 38 with respect to the bottom plate 36 of the drawer device 16 between a raised position and a lowered position. With reference to FIGS. 3 and 4, in the lowered position the distance between the top plate 38 and the bottom plate 36 is equal to a value X that corresponds to the height of the pack to be packaged. In the raised position, the distance between the top plate 38 and the bottom plate 36 is equal to a value $X+\Delta X$. The value $\Delta X$ represents the reciprocating travel in the vertical direction of the top plate 38 with respect to the bottom plate 36. A particularly advantageous characteristic of the present invention lies in the fact that the motor 52, under the control of a program implemented in a programmable-logic control unit, enables variation of the amount $\Delta X$, keeping the dimension X constant.

The aforesaid adjustment can be made also during normal operation of the machine. The variation in the value of the amount $\Delta X$ can be made manually by an operator via a control panel, or else automatically. A particularly advantageous way of managing the variation of the amount $\Delta X$ in an automatic way consists in detecting a signal that indicates the torque of the motor 21 that controls the plate 20 of the presser device that carries out compression of the pile of products. In fact, the torque of the motor 21 is proportional to the force of compression that the plate 20 exerts on the pile of products P. In turn, the force of compression in the completely lowered position of the plate is proportional to the thickness of the pile. The signal that indicates the driving torque of the motor 21 is used as a reference parameter of the specific format of the pack that the machine is producing. The machine control unit has an algorithm that enables management of the positive or negative variations in the dimension $\Delta X$ with respect to a reference value according to the variations in the pressure of compression of the pile that are signalled by the variation in the feed torque of the motor 21.

The plate 20 and the plate 38 are controlled by servo motors that have driving forces proportional to the torques and hence to the currents absorbed. The driving forces of the motors can thus be controlled and managed in a very simple way.

This possibility of adjustment enables adaptation of the machine to variations in the thickness of the pile of products to be packaged, which are, for example, due to a modification in the thickness of the individual sheets making up the pile. It should be emphasized that adjustment acts solely on the dimension $\Delta X$, whereas the dimension X, which defines the height of the pack to be packaged, remains constant. The fact that the dimension X remains constant guarantees that the packs produced using the machine according to the present invention all have the same height, even in the presence of variations in the thickness of the individual sheets making up the pack. The variation $\Delta X$ makes it possible always to have the same friction of dynamic transfer of the pile of products, which in turn guarantees proper operation of the machine as the substance of the paper or the embossing varies.

The operating cycle of the machine described above is presented in what follows. A pile of products P to be packaged is positioned in the feed station 12 and is compressed in the vertical direction by the presser device 20. A sheet F of packaging material, cut to the right size, is withheld by the suction belts 26 in a vertical plane in front of the feed station 12. The drawer device 16 sets itself in the receiving position illustrated in FIG. 4. In this position, the drawer device 16 is in the position closest to the vertical plane containing the sheet F, and the top plate 38 is in the raised position (at a distance from the bottom plate 36 equal to $X+\Delta X$). In this condition, the pusher device 22 pushes the pile P in the direction indicated by the arrow 24 in FIG. 1. The pile P passes through the plane containing the sheet F and enters the drawer device 16, between the top plate 38 and the bottom plate 36, drawing along with it the sheet F, which lays itself out on the top side, front side and bottom side of the pile P. Now, the top plate 38 of the drawer device 16 drops to carry out an action of retention on the pile P. At the same time or immediately afterwards, the drawer device 16 moves towards the right and into the position for butt welding (illustrated in FIG. 3), in which the drawer device 16 occupies the position furthest away from the plane containing the sheet F. During this travel from the receiving position to the butt-welding position, a first pair of folds are made by means of a pair of side folders 68 (only one of which can be seen in FIG. 1). Whilst the drawer device 16 is in the butt-welding position, two vertical folders 70, 72 carry out folding of the rear edges of the sheet F around the pack, as well as welding of the overlapping edges of the sheet F. Now, the drawer device 16 again moves towards the position for receiving a pack, then the top plate 36 of the drawer device 16 is raised. During the next cycle, the drawer device 16 pushes a second pack P to the right, and the pack that was partially packaged in the course of the previous cycle is pushed forward by the pack that follows it. The side folders 68 carry out a second pair of lateral folds on the first pack. Next, the first pack advances on a conveyor consisting of a motor-driven bottom belt 74 and a motor-driven top belt 76 (FIG. 1 and FIG. 3), and during this movement further lateral folds are carried out by the stationary folders 78 and 80. Packaging of the pack is completed by welding of the overlapping folds on the two side surfaces in a basically conventional way.

What is claimed is:

1. A machine for packaging piles of paper products, such as serviettes, handkerchiefs and the like, comprising:

a feed assembly for feeding a sheet of packaging material, comprising means designed to hold a sheet of packaging material in a substantially vertical plane;

a station for feeding products to be packaged, comprising a pusher designed to push the products to be packaged in a longitudinal direction orthogonal to the aforesaid sheet of packaging material;

a drawer device comprising a bottom plate and a top plate, in which the top plate is cylindrically mobile with respect to the bottom plate by a given dimension;

a first control device designed to control displacement of the drawer device in a longitudinal direction between a receiving position and a position of release of the products, a second control device, independent of the aforesaid first control device, for controlling displacement of the top plate in a vertical direction with respect to the bottom plate by the aforesaid given dimension, said control device being designed to vary the aforesaid given dimension with the machine moving, and wherein a control unit of the machine controls said variation in the given dimension as a function of a signal indicating a torque of a motor which controls compression of the pile of products to be packaged.

2. The machine according to claim 1, wherein said variation in the given dimension may be controlled by an operator by means of a control panel.

3. The machine according to claim 1, wherein said variation in the given dimension is controlled automatically by means of an algorithm managed by said control unit of the machine.

4. The machine according to claim 1, wherein said second control device comprises an electric motor which is controlled numerically by means of a programmable control unit.

5. The machine according to claim 4, wherein said electric motor controls displacement in a vertical direction of a pair of guides inside which are slidably mounted the ends of a pair of uprights carrying the aforesaid top plate.

6. The machine according to claim 5, wherein said uprights slidably engage a pair of vertical guides carried by the bottom plate of the drawer device.

7. The machine according to claim 5, wherein said vertically mobile guides are carried by a cross member connected to a rack which engages a pinion driven by the aforesaid motor.

* * * * *